US008565441B2

(12) United States Patent
Kim

(10) Patent No.: US 8,565,441 B2
(45) Date of Patent: Oct. 22, 2013

(54) METHOD AND APPARATUS FOR REDUCING RESONANCE OF LOUDSPEAKER

(75) Inventor: Oan-jin Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1575 days.

(21) Appl. No.: 12/029,002

(22) Filed: Feb. 11, 2008

(65) Prior Publication Data

US 2009/0028350 A1 Jan. 29, 2009

(30) Foreign Application Priority Data

Jul. 27, 2007 (KR) ..... 10-2007-0075875

(51) Int. Cl.
*H04R 29/00* (2006.01)

(52) U.S. Cl.
USPC ..... 381/59; 381/96; 381/58

(58) Field of Classification Search
None
See application file for complete search history.

(56) References Cited

U.S. PATENT DOCUMENTS

| | | | | |
|---|---|---|---|---|
| 4,870,690 | A | 9/1989 | Negishi et al. | |
| 5,226,089 | A | 7/1993 | Yoon et al. | |
| 6,408,079 | B1 * | 6/2002 | Katayama et al. | 381/98 |
| 2003/0142832 | A1 * | 7/2003 | Meerkoetter et al. | 381/59 |
| 2006/0133620 | A1 * | 6/2006 | Lashkari | 381/59 |
| 2007/0160221 | A1 * | 7/2007 | Pfaffinger | 381/59 |

FOREIGN PATENT DOCUMENTS

| | | | |
|---|---|---|---|
| JP | 62-60399 | A | 3/1987 |
| JP | 2000-253484 | A | 9/2000 |
| JP | 2005-223385 | A | 8/2005 |
| KR | 1993-0001077 | B1 | 2/1993 |

OTHER PUBLICATIONS

Notice of Allowance issued Feb. 28, 2012 in the corresponding Korean Application No. 10-2007-0075875.
Korean Office Action issued on Aug. 24, 2011 in the corresponding Korean Patent Application No. 10-2007-0075875.

* cited by examiner

*Primary Examiner* — Benjamin Sandvik
*Assistant Examiner* — Leslie Pilar Cruz
(74) *Attorney, Agent, or Firm* — Sughrue Mion, PLLC

(57) ABSTRACT

A method and apparatus for reducing resonance of a loudspeaker by using a model derived from a software simulated loudspeaker are provided. The method includes generating a model to determine resonance characteristics of the loudspeaker based on physical parameters of the audio reproducing device; determining accuracy of the model of the loudspeaker by comparing calculated frequency characteristics of the model of the loudspeaker and measured frequency characteristics of the loudspeaker that is outputting sound; generating a resonance reduction filter based on the model of the loudspeaker according to the determined accuracy; and reducing the resonance characteristics of the loudspeaker by applying the resonance reduction filter to input audio data.

17 Claims, 3 Drawing Sheets

METHOD AND APPARATUS FOR REDUCING RESONANCE OF LOUDSPEAKER

CROSS-REFERENCE TO RELATED PATENT APPLICATION

This application claims the benefit of Korean Patent Application No. 10-2007-0075875, filed on Jul. 27, 2007, in the Korean Intellectual Property Office, the disclosure of which is incorporated herein in its entirety by reference.

BACKGROUND OF THE INVENTION

1. Field of the Invention

Methods and apparatuses consistent with the present invention relate to reducing the resonance of a loudspeaker, and more particularly, to reducing the resonance of a loudspeaker by using a physical model derived from a software simulated loudspeaker.

2. Description of Related Art

Loudspeakers generally are electro-acoustic transducers that convert electrical signals into sounds loud enough to be heard at a distance.

Due to the popularity of flat-screen televisions, the thinner display panels become, the thinner loudspeakers become.

In order to make loudspeakers thinner, it is necessary to change the size of permanent magnets and the shape of cones of the loudspeakers. The size of the permanent magnets affects the intensity of magnetic forces and the range of movement of voice coils. A narrow range of movement of the voice coils deteriorates generation performance of low frequencies. Loudspeaker cones are not generally curved in order to effectively generate sound waves according to the range of movement of the voice coils. However, the thinner the loudspeakers become, the shorter the loudspeaker cones become. In this case, since moving directions of the voice coils are not supported, remaining vibration occurs in loudspeaker cones according to the movement of voice coils. The remaining vibration gets stronger in resonance frequencies of loudspeakers and adversely affects sound quality.

Related art methods of improving the material and shape of loudspeaker cones have been used to reduce remaining vibration. However, such related art methods increase manufacturing costs and result in generation of thick loudspeakers.

SUMMARY OF THE INVENTION

It is an aspect of the present invention to provide a method and apparatus for reducing resonance of a loudspeaker, which determine resonance characteristics of the loudspeaker by using a physical model of the loudspeaker derived from a software simulated loudspeaker and transforming audio data based on the resonance characteristics of the loudspeaker.

According to an aspect of the present invention, there is provided a method of reducing resonance of a loudspeaker of an audio reproducing device, the method comprising: generating a model to determine resonance characteristics of the loudspeaker, based on physical parameters of the audio reproducing device; determining accuracy of the model of the loudspeaker by comparing calculated frequency characteristics of the model of the loudspeaker and measured frequency characteristics of the loudspeaker that is outputting sound; generating a resonance reduction filter based on the model of the loudspeaker according to the determined accuracy; and reducing the resonance characteristics of the loudspeaker by applying the resonance reduction filter to input audio data.

According to another aspect of the present invention, there is provided an apparatus for reducing resonance of a loudspeaker comprising: a physical parameter storage unit which stores physical parameters of the loudspeaker and physical parameters of an amplifier; a model calculator which generates a model based on physical characteristics of the loudspeaker, said physical characteristics being based on the physical parameters of the loudspeaker and the physical parameters of the amplifier; and a resonance reduction processor which compares a calculated frequency response of the model of the loudspeaker and a measured frequency response of the loudspeaker, determines accuracy of the model of the loudspeaker, generates a resonance reduction filter based on the physical characteristics according to the determined accuracy, and transforms audio data according to the resonance reduction filter.

BRIEF DESCRIPTION OF THE DRAWINGS

The above and other features of the present invention will become more apparent by describing in detail exemplary embodiments thereof with reference to the attached drawings in which.

DETAILED DESCRIPTION OF THE INVENTION

The present invention will now be described more fully with reference to the accompanying drawings, in which exemplary embodiments of the invention are shown.

Figure 1:
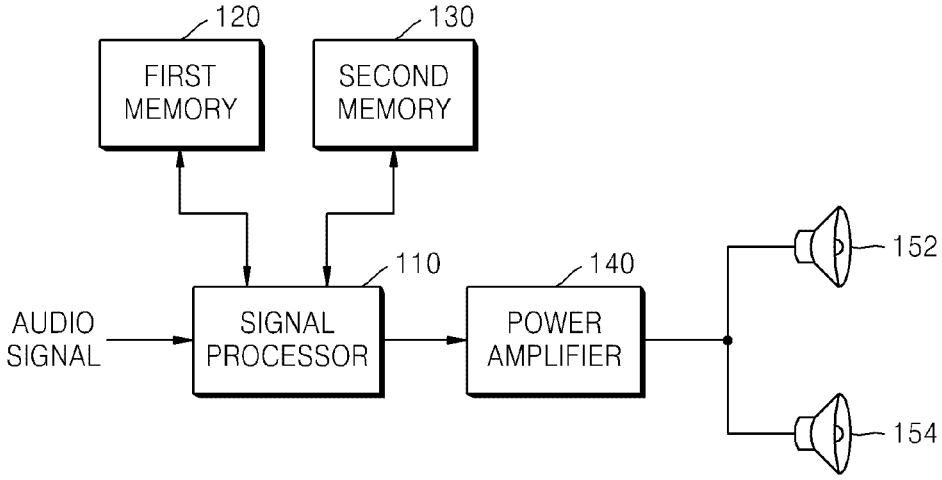
FIG. 1 is a block diagram of a loudspeaker resonance reduction system according to an exemplary embodiment of the present invention.

FIG. 1 is a block diagram of a loudspeaker resonance reduction system according to an exemplary embodiment of the present invention. Referring to FIG. 1, the loudspeaker resonance reduction system comprises a signal processor 110, a first memory 120, a second memory 130, a power amplifier 140, and left and right loudspeakers 152 and 154.

The signal processor 110 detects resonance characteristics of the left and right loudspeakers 152 and 154 using physical characteristics of an audio reproducing apparatus, and transforms an audio signal through a filter having the same resonance characteristics as the left and right loudspeakers 152 and 154. The audio signal can be an analog or digital signal. The audio reproducing apparatus has the physical characteristics of the left and right loudspeakers 152 and 154 and the power amplifier 140.

The first memory 120 temporarily stores audio data reflecting the resonance characteristics. The first memory 120 may be a random access memory (RAM).

The second memory 130 stores a coefficient of the resonance characteristics using the physical characteristics of the audio reproducing apparatus. The coefficient of the resonance characteristics can be a filter for reducing resonance. The second memory 140 may be a read only memory (ROM).

The power amplifier 140 amplifies the audio data reflecting the resonance characteristics to generate an audio signal that can be reproduced by the left and right loudspeakers 152 and 154.

The left and right loudspeakers 152 and 154 reproduce the audio signal amplified by the power amplifier 140.

Figure 2:
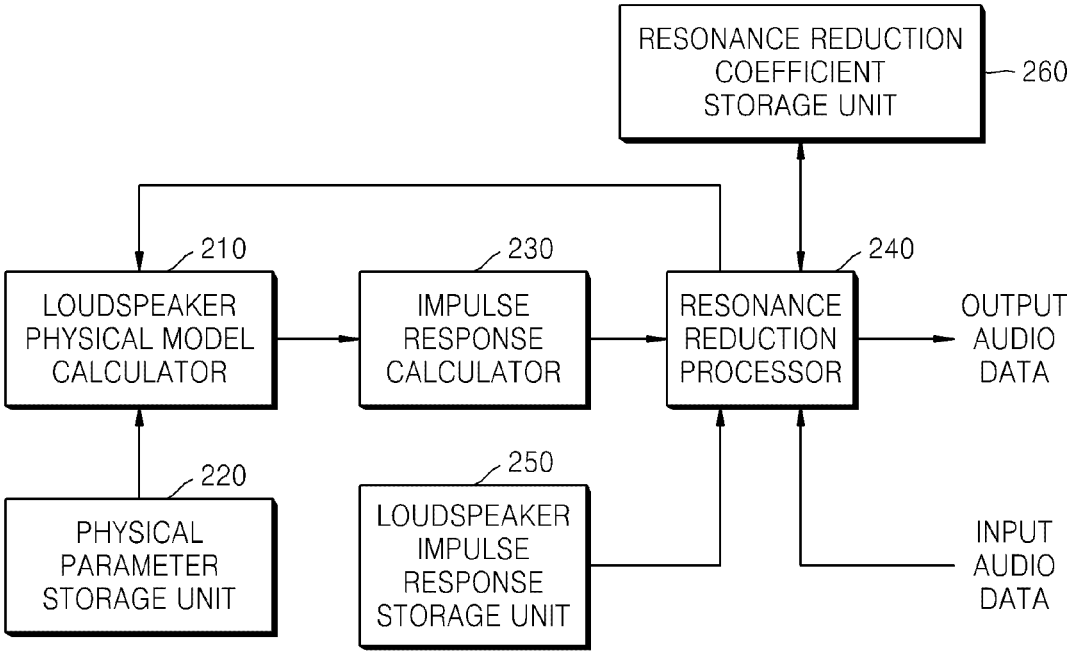
FIG. 2 is a detailed block diagram of a signal processor illustrated in FIG. 1 according to an exemplary embodiment of the present invention.

FIG. 2 is a detailed block diagram of the signal processor 110 illustrated in FIG. 1 according to an exemplary embodiment of the present invention. Referring to FIG. 2, the signal processor 110 comprises a loudspeaker physical model calculator 210, a physical parameter storage unit 220, an impulse response calculator 230, a loudspeaker impulse response storage unit 250, a resonance reduction processor 240, and a resonance reduction coefficient storage unit 260.

The physical parameter storage unit 220 stores physical parameters of a loudspeaker and physical parameters of an amplifier. The physical parameters of the loudspeaker comprise the mass of a voice coil, a damping coefficient, Young's modulus, the magnetic force of a coil electromagnet, and the like. The physical parameters of the amplifier can be expressed by using a transfer function indicating the relationship between an input audio signal and an amplified audio signal, and are delay coefficients, amplification coefficients, or the like.

The loudspeaker physical model calculator 210 calculates a physical model of the loudspeaker based on physical characteristics of the loudspeaker using the physical parameters of the loudspeaker and the physical parameters of the amplifier stored in the physical parameter storage unit 220.

The impulse response calculator 230 calculates an impulse response (or a frequency response) using the physical model of the loudspeaker calculated by the loudspeaker physical model calculator 210.

The loudspeaker impulse response storage unit 250 stores a measured impulse response (or a frequency response) of the loudspeaker that is outputting sound.

The resonance reduction processor 240 compares the calculated impulse response of the impulse response calculator 230 and the measured impulse response of the loudspeaker in the impulse response storage unit 250, and determines the accuracy of a physical model calculated by the loudspeaker physical model calculator 210. The resonance reduction processor 240 generates a resonance reduction filter based on the physical characteristics of the loudspeaker if the accuracy of the physical model is within a predetermined allowable range, and outputs a control signal for adjusting the physical characteristics of the loudspeaker to the loudspeaker physical model calculator 210 if the accuracy of the physical model is outside a predetermined allowable range. The resonance reduction processor 240 transforms audio data using the resonance reduction filter.

The resonance reduction coefficient storage unit 260 stores a coefficient of the resonance reduction filter generated by the resonance reduction processor 240.

Figure 3:
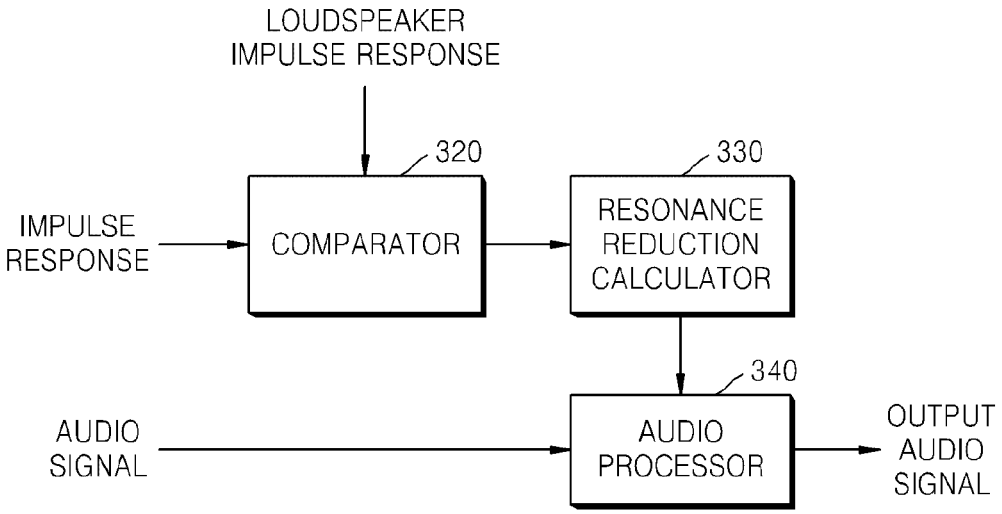
FIG. 3 is a detailed block diagram of a resonance reduction processor illustrated in FIG. 2 according to an exemplary embodiment of the present invention.

FIG. 3 is a detailed block diagram of the resonance reduction processor 240 illustrated in FIG. 2 according to an exemplary embodiment of the present invention. Referring to FIG. 3, the resonance reduction processor 240 comprises a comparator 320, a resonance reduction calculator 330, and an audio processor 340.

The comparator 320 compares the calculated impulse response of the impulse response calculator 230 and the measured impulse response of the loudspeaker impulse response storage unit 250, and determines the accuracy of the physical model calculated by the loudspeaker physical model calculator 210.

The resonance reduction calculator 330 generates a resonance reduction coefficient based on the physical model according to the accuracy determined by the comparator 320.

The audio processor 340 transforms an input audio signal according to the resonance reduction coefficient generated by the resonance reduction calculator 330. An output audio signal is transformed according to the resonance characteristics of the loudspeaker.

Figure 4:
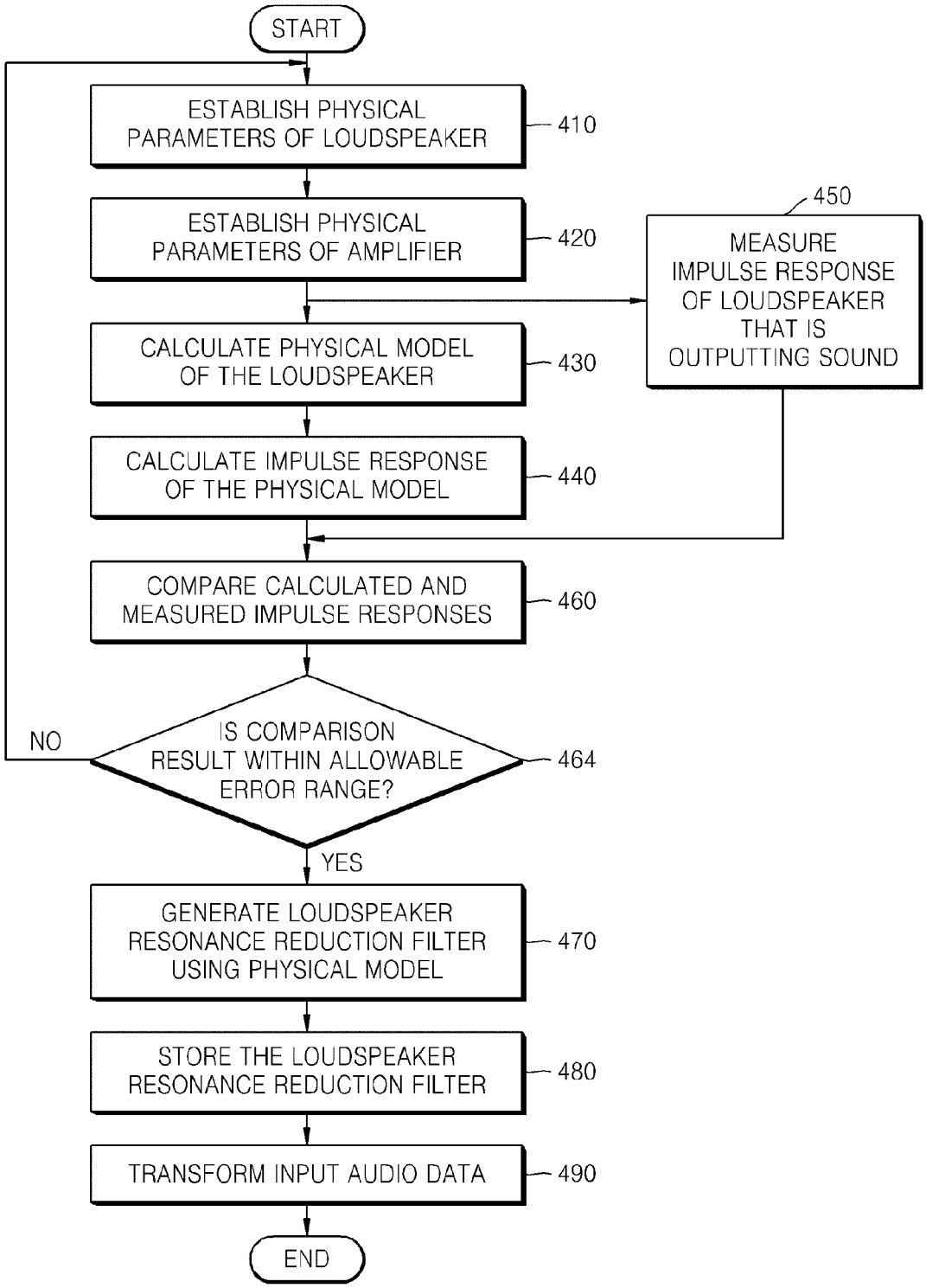
FIG. 4 is a flowchart illustrating a loudspeaker resonance reduction method according to an exemplary embodiment of the present invention.

FIG. 4 is a flowchart illustrating a loudspeaker resonance reduction method according to an exemplary embodiment of the present invention. Referring to FIG. 4, a loudspeaker is selected. Thereafter, physical parameters of the loudspeaker are established (Operation 410). The physical parameters of the loudspeaker are suggested in the specification of the loudspeaker. For example, the physical parameters of the loudspeaker can be expressed using mechanical or electrical values such as the mass of a voice coil, a damping coefficient, Young's modulus, the magnetic force of a coil electromagnet, and the like. The resonance characteristics of the loudspeaker are closely related to the physical parameters. For example, the damping coefficient and Young's modulus affect a resonance frequency and decay time, respectively.

Physical parameters of an amplifier are established using a transfer function between an input audio signal and an audio signal amplified by the amplifier (Operation 420). According to an exemplary embodiment, the physical parameters of the amplifier include electrical values such as a delay coefficient, an amplification coefficient, or the like.

An impulse response of the loudspeaker that is outputting sound is measured (Operation 450).

A physical model indicating physical characteristics of the loudspeaker is calculated using the physical parameters of the loudspeaker and the physical parameters of the amplifier (Operation 430). The physical model may be a software simulated model. The physical model of the loudspeaker may indicate the transfer function between the electrical audio data and acoustic loudspeaker output. If an input signal is i(t), an output signal is r(t), a transfer function of the amplifier is a(t), a transfer function of a loudspeaker is s(t), and a transfer function of a system is h(t), the physical model of the loudspeaker can be presented as a convolution value of the transfer function of the amplifier and the transfer function of the loudspeaker according to Equation 1. Therefore, the transfer function of the system includes the physical parameters of the loudspeaker and the physical parameters of the amplifier. The transfer function model includes resonance characteristics corresponding to a transition response.

$$r(t)=h(t)*i(t),\ h(t)=a(t)*s(t) \tag{1}$$

Thereafter, the impulse response of the physical model of the loudspeaker is calculated (Operation 440). The calculated impulse response of the physical model of the loudspeaker is an output of the loudspeaker in response to an impulse input within a predetermined period of time.

The measured impulse response of the loudspeaker that is outputting sound and the calculated impulse response of the physical model are compared by analyzing frequency characteristics using fast Fourier transformation (FFT) (Operation 460). For example, characteristic coefficients of the impulse responses are extracted and compared.

The comparison result is used to determine accuracy of the physical model. Another physical model having an impulse response similar to the measured impulse response of the loudspeaker outputting sound is obtained.

The comparison result is compared with a previously determined allowable error range in order to obtain accuracy of the physical model (Operation 464). The allowable error range is a test value or the like.

If the comparison result is outside the allowable error range, the physical parameters of the loudspeaker and the physical parameters of the amplifier are adjusted to re-calculate the physical model. The occurrence of error of the physical model is a result of an error of the physical characteristics of the loudspeaker and the amplifier.

Therefore, the physical parameters of the loudspeaker and the physical parameters of the amplifier are adjusted within the allowable error range. According to another exemplary embodiment, the physical parameters of the loudspeaker and the physical parameters of the amplifier can depend on the measured impulse response of the loudspeaker outputting sound.

If the comparison result is within the allowable error range, the obtained physical model is used to generate a filter for offsetting the resonance characteristics of the loudspeaker (Operation 470).

The filter for offsetting the resonance characteristics of the loudspeaker is stored in a specific memory (Operation 480).

The audio data is transformed using the filter to offset the resonance characteristics of the loudspeaker of an audio reproducing device (Operation 490).

The present invention may be embodied as computer readable code on a computer readable recording medium. The computer readable recording medium may be any data storage device that can store data which can be thereafter read by a computer system. Examples of the computer readable recording medium include ROM, RAM, compact disc (CD)-ROMs, magnetic tapes, floppy disks, and optical data storage devices. The computer readable recording medium can also be distributed in network coupled computer systems so that the computer readable code is stored and executed in a distributed fashion.

According to an exemplary embodiment of the present invention, a physical model of a software simulated loudspeaker is used to reduce resonance of the loudspeaker. Resonance characteristics of each type of loudspeakers are determined in order to effectively reduce the resonance characteristics of a loudspeaker.

While the present invention has been particularly shown and described with reference to exemplary embodiments thereof, it will be understood by those of ordinary skill in the art that various changes in form and details may be made therein without departing from the spirit and scope of the invention as defined by the appended claims. The exemplary embodiments should be considered in a descriptive sense only and not for purposes of limitation. Therefore, the scope of the invention is defined not by the detailed description of the invention but by the appended claims, and all differences within the scope will be construed as being included in the present invention.

What is claimed is:

1. A method of reducing resonance of a loudspeaker of an audio reproducing device, the method comprising:

generating a model of the loudspeaker to determine resonance characteristics of the loudspeaker, based on physical characteristics of the audio reproducing device;

determining accuracy of the model of the loudspeaker by comparing calculated frequency characteristics of the model of the loudspeaker and measured frequency characteristics of the loudspeaker that is outputting sound;

generating a resonance reduction filter based on the model of the loudspeaker according to the determined accuracy; and reducing the resonance characteristics of the loudspeaker by applying the resonance reduction filter to input audio data.

2. The method of claim 1, wherein the physical characteristics of the audio reproducing device comprise physical parameters of the loudspeaker and physical parameters of an amplifier.

3. The method of claim 2, wherein the physical parameters of the amplifier are expressed in a transfer function indicating a relationship between an input audio signal and an amplified audio signal.

4. The method of claim 1, wherein the model of the loudspeaker is a software simulated model that comprises a transfer function between a signal of the input audio data and an audio signal output by the loudspeaker.

5. The method of claim 1, wherein the determining of accuracy of the model of the loudspeaker comprises:

calculating an impulse response based on the model;

determining the calculated frequency characteristics of the model based on the calculated impulse response;

determining the measured frequency characteristics of the loudspeaker based on a measured impulse response of the loudspeaker that is outputting sound;

comparing the calculated frequency characteristics of the model and the measured frequency characteristics of the loudspeaker to generate a comparison result; and comparing the comparison result and an error range to determine the accuracy of the model.

6. The method of claim 5, further comprising, if the comparison result is outside the error range, adjusting the physical characteristics of the audio reproducing device to adjust the frequency characteristics of the model of the loudspeaker within the error range.

7. The method of claim 6, wherein the frequency characteristics of the model of the loudspeaker are approximated to the measured frequency characteristics of the loudspeaker.

8. The method of claim 6, wherein the adjusting of the physical characteristics of the audio reproducing device comprises adjusting physical parameters of the loudspeaker and physical parameters of an amplifier based on the measured frequency characteristics of the loudspeaker.

9. The method of claim 1, wherein the determining the accuracy of the model comprises:

providing an input audio signal to the model of the loudspeaker;

calculating the frequency characteristics of an impulse signal of the model of the loudspeaker that is responsive to the input audio signal;

providing a same input audio signal to the loudspeaker;

measuring the frequency characteristics of an output signal of the loudspeaker that is output in response to the input audio signal; and determining difference values between the frequency characteristics of the impulse signal of the model and the frequency characteristics of the output signal of the loudspeaker.

10. The method of claim 1, wherein the physical characteristics of the audio reproducing device comprise physical parameters of the loudspeaker that comprise at least one of:

a mass of a voice coil, a damping coefficient,

Young's modulus, and a magnetic force of a coil electromagnet.

11. The method of claim 10, wherein the physical characteristics of the audio reproducing device further comprise physical parameters of an amplifier that comprise at least one of:

a delay coefficient, and an amplification coefficient.

12. An apparatus for reducing resonance of a loudspeaker comprising:

a physical parameter storage unit which stores physical parameters of the loudspeaker and physical parameters of an amplifier;

a model calculator which generates a model based on physical characteristics of the loudspeaker, said physical characteristics being based on the physical parameters of the loudspeaker and the physical parameters of the amplifier; and a resonance reduction processor which compares a calculated frequency response of the model of the loudspeaker and a measured frequency response of the loudspeaker, determines accuracy of the model of the loudspeaker, generates a resonance reduction filter based on the model according to the determined accuracy, and transforms audio data according to the resonance reduction filter.

13. The apparatus of claim 12, wherein the resonance reduction processor generates a control signal for adjusting the physical characteristics if the determined accuracy is outside an allowable error range.

14. The apparatus of claim 12, wherein the resonance reduction processor comprises:

a comparator which compares the calculated frequency response and the measured frequency response, and determines the accuracy of the model of the loudspeaker;

a resonance reduction calculator which generates the resonance reduction filter based on the model of the loudspeaker according to the determined accuracy; and an audio processor which transforms the audio data according to the resonance reduction filter.

15. The apparatus of claim 12, further comprising:

an impulse response calculator which calculates the calculated frequency response based on the physical characteristics of the loudspeaker; and a loudspeaker impulse response storage unit which stores the measured frequency response of the loudspeaker.

16. A loudspeaker resonance reduction system comprising:

a signal processor which detects resonance characteristics of a loudspeaker based on physical characteristics of an audio reproducing device, and transforms audio data through a filter reducing the resonance characteristics of the loudspeaker;

a memory which stores the resonance characteristics of the loudspeaker detected by the signal processor based on the physical characteristics of the audio reproducing device;

a power amplifier which amplifies the audio data reflecting the resonance characteristics of the loudspeaker in the signal processor to an audio signal; and the loudspeaker which reproduces the audio signal.

17. The system of claim 16, wherein the signal processor comprises:

a physical parameter storage unit which stores physical parameters of the loudspeaker and physical parameters of an amplifier;

a model calculator which calculates a model of the loudspeaker based on physical characteristics of the loudspeaker, said physical characteristics being based on the physical parameters of the loudspeaker and the physical parameters of the amplifier; and a resonance reduction processor which compares a calculated frequency response of the model of the loudspeaker and a measured frequency response of the loudspeaker, determines accuracy of the model of the loudspeaker, generates the filter based on the model according to the determined accuracy, and transforms the audio data according to the filter.

* * * * *